US009512381B2

(12) United States Patent
Larem et al.

(10) Patent No.: US 9,512,381 B2
(45) Date of Patent: Dec. 6, 2016

(54) LUBRICITY ENHANCING ADDITIVES, A METHOD FOR PRODUCING THE SAME AND USE THEREOF

(75) Inventors: David Larem, Eppertshausen (DE); Sandra Horstmann, Mannheim (DE); Steffen Sandhöfner, Neulußheim (DE)

(73) Assignee: Rhein Chemie Rheinau GmbH, Mannheim (DE)

( * ) Notice: Subject to any disclaimer, the term of this patent is extended or adjusted under 35 U.S.C. 154(b) by 460 days.

(21) Appl. No.: 13/318,485

(22) PCT Filed: May 3, 2010

(86) PCT No.: PCT/EP2010/055969

§ 371 (c)(1),
(2), (4) Date: Mar. 26, 2012

(87) PCT Pub. No.: WO2010/128012

PCT Pub. Date: Nov. 11, 2010

(65) Prior Publication Data

US 2012/0245066 A1 Sep. 27, 2012

(30) Foreign Application Priority Data

May 5, 2009 (DE) ..... 10 2009 019 698

(51) Int. Cl.

| | |
|---|---|
| ***C10M 159/06*** | (2006.01) |
| ***C10L 1/22*** | (2006.01) |
| ***C10M 169/04*** | (2006.01) |
| ***C10M 159/12*** | (2006.01) |
| ***C10M 145/36*** | (2006.01) |
| ***C10M 173/02*** | (2006.01) |

(52) U.S. Cl.

CPC ..... *C10M 159/12* (2013.01); *C10M 145/36* (2013.01); *C10M 173/02* (2013.01); *C10M 2209/103* (2013.01); *C10M 2209/104* (2013.01); *C10M 2209/108* (2013.01); *C10N 2230/06* (2013.01); *C10N 2240/40* (2013.01)

(58) Field of Classification Search

CPC .. C10M 129/66; C10M 129/16; C10M 129/18
USPC ..... 508/451, 452, 491
See application file for complete search history.

(56) References Cited

U.S. PATENT DOCUMENTS

| | | | | |
|---|---|---|---|---|
| 2,401,055 | A | 5/1946 | De Grotte | |
| 2,510,335 | A * | 6/1950 | Keiser et al. | 560/127 |
| 2,547,760 | A * | 4/1951 | Konen | 554/26 |
| 3,298,954 | A | 1/1967 | Brown | |
| 3,623,987 | A | 11/1971 | Ker | |
| 3,994,948 | A | 11/1976 | Jayne et al. | |
| 4,331,549 | A | 5/1982 | Bremmer | |
| 5,512,134 | A | 4/1996 | Daute et al. | |
| 5,618,779 | A * | 4/1997 | Klein et al. | 508/486 |
| 5,916,854 | A * | 6/1999 | Inaya et al. | 508/452 |
| 6,472,352 | B1 | 10/2002 | Hacias | |
| 2004/0248744 | A1* | 12/2004 | King | C10M 169/04 508/437 |
| 2006/0128573 | A1 | 6/2006 | Botz et al. | |
| 2007/0037953 | A1 | 2/2007 | Geiger et al. | |
| 2007/0142544 | A1 | 6/2007 | Jenkines et al. | |
| 2007/0151480 | A1* | 7/2007 | Bloom | C08F 8/04 106/220 |

OTHER PUBLICATIONS

Fauve, Marius, Self-emulsifiable oils in paints, Double-Liaison, pp. 103, 33-6 39-42 (1964).
BASF Handbook Lackiertechnik [Coating Technology] 2002, p. 36.
International Search Report from co-pending Application PCT/EP2010/055969 dated Aug. 24, 2010, 4 pages.
German Search Report from co-pending Application No. 102009019698.6-43 dated Nov. 16, 2009, 3 pages.

* cited by examiner

*Primary Examiner* — Prem C Singh
*Assistant Examiner* — Francis C Campanell

(57) ABSTRACT

The invention relates to novel lubricity enhancing additives, to a method for producing the same, and to the use thereof.

15 Claims, No Drawings

LUBRICITY ENHANCING ADDITIVES, A METHOD FOR PRODUCING THE SAME AND USE THEREOF

The invention relates to novel lubricity enhancing additives, a method for producing the same and use thereof.

Lubricity enhancing additives based on native oils are known in the form of native oils themselves, as blown (=oxidized) native oils and as alkoxylated native oils. Native oils and blown native oils have the disadvantage that they are immiscible with water and, as a result, when they are used in water-miscible lubricants, emulsifiers have to be added. Furthermore, native and alkoxylated native oils contribute only to a limited extent to the lubricity of lubricants.

It was therefore the object to provide very effective lubricity enhancing additives based on native oils which are water-miscible without using emulsifiers.

Surprisingly, it has now been found that the lubricity enhancing additives according to the invention achieve this object.

The present invention therefore provides lubricity enhancing additives comprising the reaction product of at least one alkylene oxide with at least one stand oil and/or a blown native oil.

Within the context of the invention, alkylene oxides are ethylene oxide, propylene oxide, 1,2-butylene oxide, 2,3-butylene oxide, 1,2-pentylene oxide, 2,3-pentylene oxide, 1,2-hexylene oxide, 3-methyl-1,2-pentylene oxide, 2,3-octylene oxide, 4-methyl-2,3-octylene oxide, 4-methyl-1,2-hexylene oxide and/or 3-methyl-1,2-butylene oxide, with ethylene oxide being particularly preferred. The alkylene oxides specified above are commercially available products, e.g. from BASF AG.

Within the context of the invention, native oils are oils of natural origin, such as e.g. babussa oil, cottonseed oil, borage oil, thistle oil (=safflower oil), peanut oil, currant seed oil, hazelnut oil, herring oil, wood oil, jojoba oil, coconut oil, neatsfoot oil (pig grease), bone oil, lard oil, liver oil, linseed oil, corn oil, almond oil, olive oil, palm oil, palm kernel oil, rapeseed oil (=colza oil), beef tallow (=suet), castor oil, sardine oil, mustard seed oil, soybean oil, sunflower oil, shea butter, tall oil, grapeseed oil, whale oil and/or walnut oil. Preference is given to using refined variants thereof. The use of partially hydrogenated variants is likewise possible. All of the aforementioned oils are customary, e.g. available from Gustav Heess.

Within the context of the invention, blown native oils are native oils polymerized with the introduction of air which are produced by blowing in hot air at temperatures of preferably 100 to 150° C. As a result of the treatment, a molecule enlargement takes place via oxygen bridges, as described e.g. in the BASF handbook Lackiertechnik [Coating technology] 2002, p. 36 (ISBN 3878703244). Blown native oils typically have a kinematic viscosity (in accordance with DIN 51562) at 40° C. between 100 and 10 000 $mm^2/s$. The aforementioned blown native oils are standard commercial products, e.g. available from Gustav Heess.

Preference is given here to blown rapeseed oil (=blown colza oil).

Within the context of the invention, stand oils are native oils polymerized with the exclusion of air and are produced at temperatures of 260 to 300° C. As a result of the treatment, a molecule enlargement takes place via polymerization reactions of the double bonds, as described e.g. in the BASF handbook Lackiertechnik [Coating technology] 2002, p. 36 (ISBN 3878703244). Stand oils typically have a kinematic viscosity (in accordance with DIN 51562) at 40° C. between 100 and 10 000 $mm^2/s$. The aforementioned stand oils are standard commercial products, e.g. available from Alberdingk Boley GmbH.

In one embodiment of the invention, the lubricity enhancing additives can also comprise further additives, which vary depending on the intended use, such as e.g. standard commercial antifoams, surfactants, dispersants, solubility promoters, biocides, extreme pressure additives, antiwear additives, corrosion inhibitors, antioxidants, alkalizers, complexing agents, sequestrants, demulsifiers, viscosity index improvers, flame retardants, lubricity improvers, fragrances and/or dyes. The lubricity enhancing additives according to the invention can also comprise emulsifiers, although miscibility with water is already present even without emulsifiers.

Reaction product stands for the product formed by the alkoxylation (reaction with the alkylene oxide) of at least one stand oil and/or a blown native oil in the presence of a catalyst. For the alkoxylation, the conditions detailed below under the method according to the invention are applicable.

Preferably, the reaction with the alkylene oxide takes place in the ratio of 1-99% by weight of stand oil and/or blown native oil to 99-1% by weight of alkylene oxide. The ratio depends on the intended water miscibility.

Particular preference is given to the ratio of 30-50% by weight of stand oil and/or blown native oil to 70-50% by weight of alkylene oxide.

Particular preference is given here to the reaction product of blown rapeseed oil with ethylene oxide. Very particular preference is given then to a ratio of 30-50% by weight of blown rapeseed oil to 70-50% by weight of ethylene oxide.

Moreover, the invention provides a method for producing the lubricity enhancing additives according to the invention, according to which at least one alkylene oxide is reacted with at least one stand oil and/or blown native oil in the presence of a catalyst.

The reaction product is formed preferably at a temperature of 100 to 190° C. and a pressure of 1 to 6 bar using a nucleophilic catalyst. Nucleophilic catalysts are e.g. alcoholates, preferably alkali metal alcoholates, particularly preferably sodium methanolate, hydroxides, such as e.g. sodium hydroxide, or amines, such as e.g. triethanolamine. The reaction temperature is preferably in the range from 140 to 180° C., particularly preferably 160 to 180° C. The catalyst used is preferably alkali metal alcoholates, particularly preferably sodium methanolate.

In the reaction detailed above, the stand oil, the blown native oil or a mixture of the two oils can be used. Preferably, the reaction takes place with the alkylene oxide in the ratio of 1-99% by weight of stand oil and/or blown native oil to 99-1% by weight of alkylene oxide. Particular preference is given to the ratio of 30-50% by weight of stand oil and/or blown native oil to 70-50% by weight of alkylene oxide.

The invention likewise provides lubricants which comprise at least one lubricity enhancing additive according to the invention. The term lubricants here includes all lubricants, in particular those in accordance with ISO 6743.

Moreover, the present invention includes a method for lubricating machines and/or for working metal, according to which at least one lubricity enhancing additive according to the invention is used.

Moreover, the invention provides the use of the lubricity enhancing additives according to the invention in all lubricants according to ISO 6743, such as e.g. lubricants for metalworking or lubricants for machines.

The lubricity enhancing additives according to the invention are preferably used in water-miscible or water-mixed cooling lubricants. These are described in DIN 51385.

The scope of the invention includes all of the definitions, parameters and explanations above and below, specified generally or within preferred ranges, among one another, thus also between the respective ranges and preferred ranges in any desired combination.

The examples below serve to illustrate the invention without thereby limiting it.

WORKING EXAMPLE

In the example below, the percentages are % by weight.

Example 1

Reaction product of 40% blown colza oil and 60% ethylene oxide.

As starting material, standard commercial blown colza oil (Lubrirob S 100, Novance) with a kinematic viscosity (in accordance with DIN 51562) at 40° C. of 2500 $mm^2/s$ was used. The reaction with ethylene oxide was carried out in the presence of 0.2% sodium methanolate at a temperature of 180° C. and a pressure of 5 bar.

The reaction product had a kinematic viscosity (in accordance with DIN 51562) at 40° C. of 750 $mm^2/s$. The reaction product was dissolved at 25° C. to 0.2%, 1% and 5% completely in demineralized water (demin. water). Transparent solutions with low opalescence resulted.

Furthermore, tribological measurements were carried out with the solutions. For the comparison, aqueous solutions of a standard commercial ethoxylated native oil, namely castor oil ethoxylate with 36 mol of ethylene oxide (EO) per mole of castor oil (Emulsogen EL 360, Clariant), were tested.

| | Reaction product of 40% blown colza oil and 60% ethylene oxide (according to the invention) Reichert abrasion wear with steel test pieces Load: 1.5 kg Path: 100 m | | Castor oil ethoxylate with 36 mol of ethylene oxide per mole of castor oil (comparative example) Reichert abrasion wear with steel test pieces Load: 1.5 kg Path: 100 m | |
|---|---|---|---|---|
| | Wear calotte ($mm^2$) | Pressure absorption ($N/cm^2$) | Wear calotte ($mm^2$) | Pressure absorption ($N/cm^2$) |
| 0.2% strength solution in demin. water | 24.5 | 1200 | 28.2 | 1030 |
| 1.0% strength solution in demin. water | 13.5 | 2180 | 20.2 | 1490 |
| 5.0% strength solution in demin. water | 11.2 | 2630 | 13.1 | 2160 |

The following rule applies to the test results: the smaller the wear calotte and the larger the pressure absorption, the better the lubricity of the substance under investigation. The blank values of demin. water are for the wear calotte 36.8 $mm^2$ and for the pressure absorption 800 $N/cm^2$.

It is clear from the measurements that the lubricity enhancing additive according to the invention in aqueous solution has a significantly higher pressure absorption than the standard commercial ethoxylated native oil used in the comparative example. It has thus been shown that the lubricity enhancing additive according to the invention is very effective with regard to the lubricity.

What is claimed is:

1. A water-miscible lubricity enhancing additive consisting of the product of an alkoxylation reaction between only an alkylene oxide and a blown native oil, wherein the blown native oil is a native oil polymerized only by blowing hot air through the native oil, and the product is water-miscible.

2. The lubricity enhancing additive of claim 1, wherein:

the alkylene oxide is ethylene oxide, propylene oxide, 1,2-butylene oxide, 2,3-butylene oxide, 1,2-pentylene oxide, 2,3-pentylene oxide, 1,2-hexylene oxide, 3-methyl-1,2-pentylene oxide, 2,3-octylene oxide, 4-methyl-2,3-octylene oxide, 4-methyl-1,2-hexylene oxide and/or 3-methyl-1,2-butylene oxide; and the native oil is babussa oil, cottonseed oil, borage oil, thistle oil, peanut oil, currant seed oil, hazelnut oil, herring oil, wood oil, jojoba oil, coconut oil, neatsfoot oil, bone oil, lard oil, liver oil, linseed oil, corn oil, almond oil, olive oil, palm oil, palm kernel oil, rapeseed oil, beef tallow, castor oil, sardine oil, mustard seed oil, soybean oil, sunflower oil, rhea butter, tail oil, grapeseed oil, whale oil, walnut oil, and/or refined and partially hydrogenated variants thereof.

3. The lubricity enhancing additive of claim 1, wherein the lubricity enhancing additive is ethoxylated blown native oil.

4. The lubricity enhancing additive of claim 1, wherein:

the alkylene oxide is ethylene oxide; and the blown native oil is blown rapeseed oil.

5. The lubricity enhancing additive of claim 1, wherein the lubricity enhancing additive is ethoxylated blown rapeseed oil.

6. The lubricity enhancing additive of claim 1, wherein the blown native oil is polyhydroxylic and the alkoxylation reaction is done in the absence of further polyhydroxylic alcohols.

7. A method for producing the lubricity enhancing additive according to claim 1, the method comprising alkoxylating only the blown native oil in the presence of a catalyst.

8. The method of claim 7, wherein:

the alkylene oxide is ethylene oxide, propylene oxide, 1,2-butylene oxide, 2,3-butylene oxide, 1,2-pentylene oxide, 2,3-pentylene oxide, 1,2-hexylene oxide, 3-methyl-1,2-pentylene oxide, 2,3-octylene oxide, 4-methyl-2,3-octylene oxide, 4-methyl-1,2-hexylene oxide and/or 3-methyl-1,2-butylene oxide; and the native oil is babussa oil, cottonseed oil, borage oil, thistle oil, peanut oil, currant seed oil, hazelnut oil, herring oil, wood oil, jojoba oil, coconut oil, neatsfoot oil, bone oil, lard oil, liver oil, linseed oil, corn oil, almond oil, olive oil, palm oil, palm kernel oil, rapeseed oil, beef tallow, castor oil, sardine oil, mustard seed oil, soybean oil, sunflower oil, shea butter, tall oil, grapeseed oil, whale oil, walnut oil, and/or refined and partially hydrogenated variants thereof.

9. The method of claim 8, wherein the alkoxylation is done at a ratio of 30-50 wt % blown native oil to 70-50 wt % alkylene oxide at a temperature of 100 to 190° C., a pressure of 1 to 6 bar, and in the presence of a nucleophilic catalyst.

10. The method of claim 9, wherein the nucleophilic catalyst is a selected from the group consisting of alcoholates, hydroxides and amines.

11. The method of claim 10, wherein the catalyst is sodium methanolate.

12. The method of claim 11, wherein the temperature is 160 to 180° C.

13. The method of claim 7, wherein the blown native all is polyhydroxylic and the alkoxylation reaction is done in the absence of further polyhydroxylic alcohols.

14. The method of claim 13, wherein:

the alkylene oxide is ethylene oxide; and the blown native oil is blown rapeseed oil.

15. A water-miscible lubricant comprising the lubricity enhancing additive according to claim 1.

* * * * *